US009775487B2

(12) United States Patent
Nelson

(10) Patent No.: US 9,775,487 B2
(45) Date of Patent: Oct. 3, 2017

(54) APPARATUS, SYSTEMS AND METHODS FOR CLEANING AND POLISHING ACCESSORIES

(71) Applicant: Clinton D. Nelson, Wauconda, IL (US)

(72) Inventor: Clinton D. Nelson, Wauconda, IL (US)

( * ) Notice: Subject to any disclaimer, the term of this patent is extended or adjusted under 35 U.S.C. 154(b) by 219 days.

(21) Appl. No.: 14/596,976

(22) Filed: Jan. 14, 2015

(65) Prior Publication Data

US 2015/0196937 A1 Jul. 16, 2015

Related U.S. Application Data

(60) Provisional application No. 61/927,791, filed on Jan. 15, 2014, provisional application No. 61/928,639, filed on Jan. 17, 2014.

(51) Int. Cl.

| | |
|---|---|
| ***B08B 3/00*** | (2006.01) |
| ***A47L 15/00*** | (2006.01) |
| ***B08B 3/02*** | (2006.01) |
| ***F22B 1/28*** | (2006.01) |

(52) U.S. Cl.

CPC ..... *A47L 15/0015* (2013.01); *B08B 3/02* (2013.01); *F22B 1/284* (2013.01); *B08B 2230/01* (2013.01); *Y10T 137/0318* (2015.04); *Y10T 137/0352* (2015.04); *Y10T 137/87652* (2015.04)

(58) Field of Classification Search

CPC ..... B08B 2230/01; B08B 3/12; B08B 3/026; A61L 2/07; A47L 11/34

USPC ..... 134/184, 1, 117, 135, 156, 198, 30, 34, 134/104, 200, 26, 36, 42, 901, 92, 102.1; 15/320, 321, 322, 105, 268, 339, 319, 15/104.92; 422/292, 26, 28, 295, 300, 422/307, 1, 119

See application file for complete search history.

(56) References Cited

U.S. PATENT DOCUMENTS

| | | | | |
|---|---|---|---|---|
| 3,436,852 A * | 4/1969 | Stansbury | D06F 75/12 | 38/77.6 |
| 3,910,498 A * | 10/1975 | Harrison | F22B 1/284 | 222/146.5 |
| 4,414,037 A * | 11/1983 | Friedheim | B08B 3/02 | 122/40 |
| 4,878,458 A * | 11/1989 | Nelson | F22B 1/284 | 122/14.21 |
| 6,006,009 A * | 12/1999 | Friedheim | F22B 35/008 | 122/479.1 |
| 7,257,319 B1 * | 8/2007 | Clarke | B08B 3/02 | 134/102.1 |
| 7,931,857 B2 * | 4/2011 | Ramaccioni | B01F 3/04049 | 134/36 |

* cited by examiner

*Primary Examiner* — David Cormier
*Assistant Examiner* — Thomas Bucci
(74) *Attorney, Agent, or Firm* — Scherrer Patent & Tradmark Law, P.C.; Stephen T. Scherrer; Monique A. Morneault

(57) ABSTRACT

The present invention relates to accessories. Specifically, the present invention relates to cleaning accessories such as jewelry that have small crevices, impressions, engravings, or other fine details that are difficult to reach and clean. Even more specifically, the present invention relates to polishing and drying the cleaned accessories by using an allotment of polishing compound and/or steam.

14 Claims, 1 Drawing Sheet

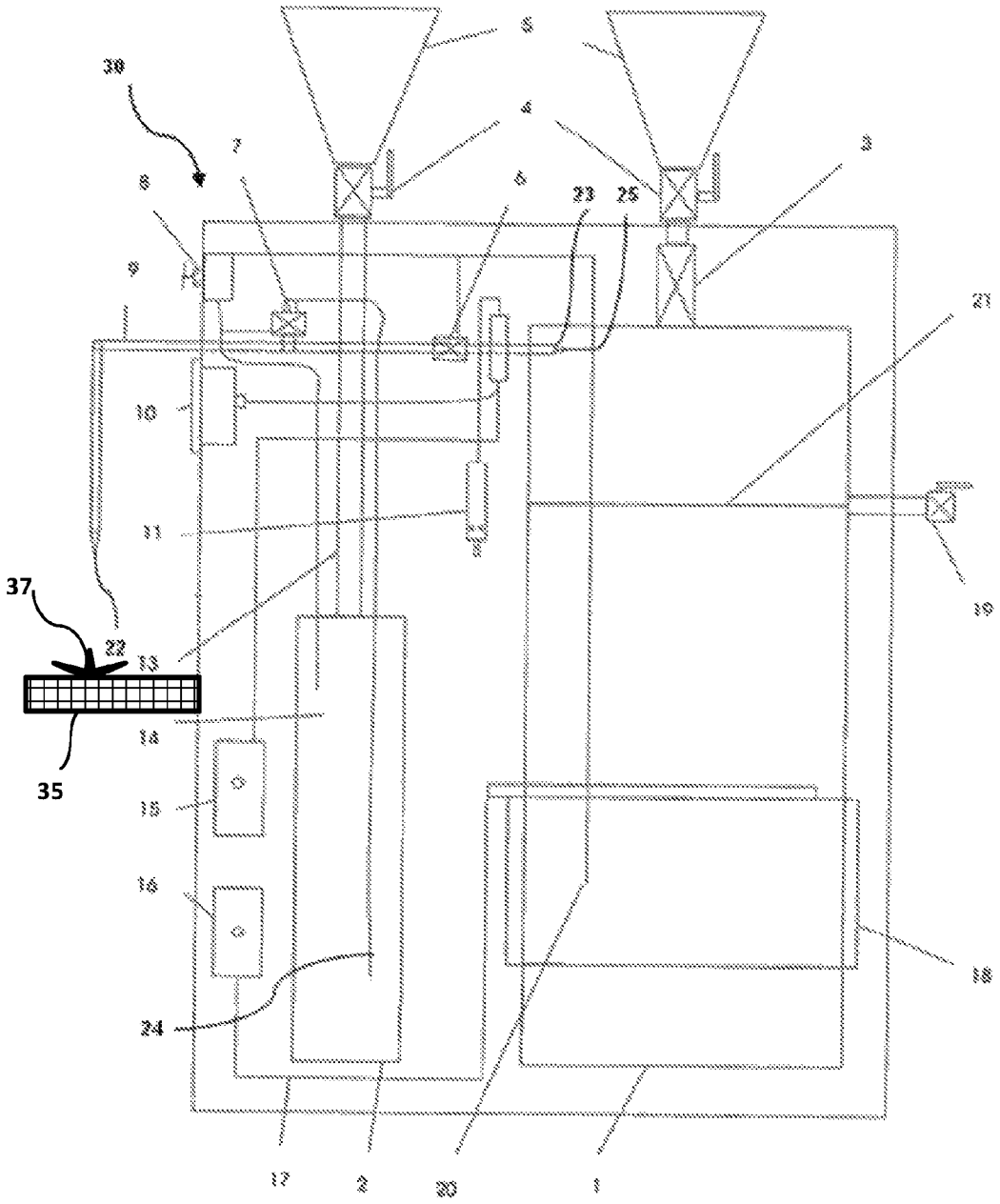
30
5
4
3
7
6
8
23
25
9
21
10
11
19
37
22
13
14
35
15
16
18
24
17
2
20
1

APPARATUS, SYSTEMS AND METHODS FOR CLEANING AND POLISHING ACCESSORIES

The present invention claims priority as a non-provisional application under 35 U.S.C. 119 to U.S. Provisional Patent Application No. 61/927,791 entitled "Apparatus, Systems and Methods for Cleaning Accessories," filed Jan. 15, 2014, and to and U.S. Provisional Patent Application No. 61/928,639 entitled "Apparatus, Systems and Methods for Cleaning Accessories," filed Jan. 17, 2014, which are both incorporated herein by reference in their entirety.

TECHNICAL FIELD

The present invention relates to accessories. Specifically, the present invention relates to cleaning accessories that have small settings, crevices, impressions, engravings, or other fine details that are difficult to reach and clean. Even more specifically, the present invention relates to polishing and drying the cleaned accessories.

BACKGROUND

It is, of course, generally known to clean and polish accessories such as jewelry, gemstones, glasses, lens, etc. Commonly, accessories are cleaned and polished by hand using brushes, solutions, or cleaning devices. Brushes can be effective ways of removing grime, tarnish or other material, but are generally a more abrasive method of cleaning. Additionally, brushes don't get into small crevices, settings, or underneath stones and gems. Brushes can be or become coarse and damage small accessories, sometimes without knowing of or seeing the damage. Once an accessory is damaged it may be impossible or extremely expensive to fix. A need exists for an apparatus, system, and method for delicately and completely cleaning accessories including small crevices, settings, and underneath stones and gems.

Home cleaning solutions are a common alternative to cleaning accessories by brush. Often these home cleaning solutions involve using vodka, Alka-Seltzer, window cleaner, vinegar, toothpaste, ketchup, denture tablets, club soda, beer, baking soda, ammonia, powdered detergent and aluminum foil. Different solutions are generally used for different accessories. Using the wrong solution could damage or destroy the accessory the solution is used on. Similarly, using too much of a solution or applying the solution for too long can also damage the accessory. A need exists for an apparatus, system, and method for controlling the amount of solution used.

Regularly, cleaning devices such as ultrasonic cleaners or steam cleaners are used to clean accessories. Ultrasonic cleaners generally work by sending ultrasonic waves through liquids such as water, cleaner, or other chemical liquids. As the ultrasonic waves pass through the liquids, bubbles form around an accessory and pull dirt, grime, or other material from the accessory. The bubbles leave the accessory and remove the dirt, grime, tarnish, or other material. An accessory must be freely suspended using ultrasonic cleaning so that the liquid can surround the accessory on all sides. Commonly, ultrasonic cleaning does not sterilize the accessories it cleans, leaving harmful microbial life such as spores, bacterial, viruses, etc. A need exists for an apparatus, system, and method for sterilizing the entire accessory.

It is commonly known to use steam cleaners to clean and sterilize accessories. Steam cleaners can heat water to temperatures above boiling, such as 115-155 degrees Celsius or 240-310 degrees Fahrenheit. The water vapor produced by the heating can be compressed, pressurized, and thereafter exposed to accessories. The hot water vapor cleanses surfaces by breaking the bonds of soil, grime, tarnish, or other materials that cling to the accessory. Steam cleaners do not require chemical or cleaning solutions in order to clean and sterilize accessories. Even still, once an accessory is cleaned and sterilized, the accessory often needs to be polished to look its best. Ultrasonic and steam cleaners fail to polish accessories. A need, therefore, exists for an apparatus, system, and method for cleaning and polishing an accessory.

Generally, brushes or cloths are used to polish accessories. It is common to use an electric polisher to polish accessories, which is usually a circular brush or cloth connected to a motor. As the motor revolves the circular brush or cloth, an accessory may be pressed against the rotating brush or cloth to polish the accessory. This can be difficult to manage because an accessory may be thrown at a high velocity if it's not held securely. Also, as mentioned earlier, using brushes or cloths may damage an accessory. Further, this adds an extra step to the cleaning process. You may have to polish an accessory after cleaning and/or you may have to clean an accessory after polishing. A need, therefore, exists for an apparatus, system, and method for safely and easily cleaning and polishing an accessory.

SUMMARY OF THE INVENTION

The present invention relates to accessories. Specifically, the present invention relates to cleaning accessories such as jewelry that have small crevices, impressions, engravings, or other fine details that are difficult to reach and clean. Even more specifically, the present invention relates to polishing and drying the cleaned accessories by using an allotment of polishing compound and/or steam.

The terms "mix," "mixed," "mixing," and "mixture" used herein are used to define varying levels of two compounds combined together. Applicant intends that each compound to be "mixed" may vary between 0% and 100% such that the combination could be all of one compound and none of the other, half one compound and half the other, any variance therebetween, or any other combination thereof.

To this end, in an embodiment of the present invention, a cleaning and polishing apparatus is provided. The cleaning and polishing apparatus comprises a water tank capable of holding water and steam, a compound tank, a mixing valve disposed between the compound tank and water tank for combining water and compound, and a nozzle for expelling a gaseous mixture of water and compound.

In an alternate embodiment of the present invention, a system for cleaning and polishing an accessory is provided. The system comprises a cleaning and polishing apparatus comprising a water tank capable of holding water and steam, a compound tank, a mixing valve disposed between the compound tank and water tank for combining water and compound, and a nozzle for expelling a gaseous mixture of water and compound, an accessory, and an accessory tray disposed beneath the nozzle, wherein the accessory tray is capable of holding the accessory for cleaning and polishing the same.

In an alternate embodiment of the present invention, a method for cleaning and polishing an accessory is provided. The method comprises the steps of providing a cleaning and polishing apparatus comprising a water tank capable of holding water and steam, a compound tank, a mixing valve disposed between the compound tank and water tank for combining water and compound, and a nozzle for expelling a mixture of steam and compound, providing an accessory, adjusting the mixing valve to a desired allotment of steam and compound, and opening the release valve exposing the accessory to the desired allotment of steam and compound.

It is, therefore, an advantage and objective of the present invention to provide an apparatus, system, and method for delicately and completely cleaning accessories including small crevices, settings, and underneath stones and gems.

Moreover, it is an advantage and objective of the present invention to provide an apparatus, system, and method for controlling the amount of solution used.

Also, it is an advantage and objective of the present invention to provide an apparatus, system, and method for sterilizing the entire accessory.

Furthermore, it is an advantage and objective of the present invention to provide an apparatus, system, and method for cleaning and polishing an accessory.

Likewise, it is an advantage and objective of the present invention to provide an apparatus, system, and method for safely and easily cleaning and polishing an accessory.

Additional features and advantages of the present invention are described in, and will be apparent from, the detailed description of the presently preferred embodiments and from the drawings.

BRIEF DESCRIPTION OF THE DRAWINGS

The drawing FIGURE depict one or more implementations in accord with the present concepts, by way of example only, not by way of limitations. In the FIGURE, like reference numerals refer to the same or similar elements.

FIG. 1 illustrates a schematic of a cleaning and polishing apparatus in an embodiment of the present invention.

DETAILED DESCRIPTION

The present invention relates to accessories. Specifically, the present invention relates to cleaning accessories such as jewelry that have small crevices, impressions, engravings, or other fine details that are difficult to reach and clean. Even more specifically, the present invention relates to polishing and drying the cleaned accessories by using an allotment of polishing compound and/or steam.

Now referring to the FIGURE, wherein like numerals refer to like parts, FIG. 1 illustrates a cleaning and polishing apparatus 30. The cleaning and polishing apparatus 30 may be a self-contained unit as shown in FIG. 1. A water tank 1 may be disposed at location inside the cleaning and polishing apparatus 30. The water tank 1 may be filled by using a funnel 5 and opening a fill valve 4. Once the water tank 1 is filled, the funnel 5 may be removed and the fill valve 4 may be closed. Of course, additional filling methods known to one skilled in the art may be used such as using a cup, having a direct line of water, using a hose, or other known filling technique. The water tank 1 may have a blowout preventer 3 disposed between the fill valve 4 and the water tank 1 to prevent air, water, and/or steam from being expelled from the fill valve 4.

The water tank 1 may be able to hold an amount of water. Preferably, the water may not exceed a maximum water level 21. To make sure no water exceeds the maximum water level 21, a release valve 19 may be provided. The release valve 19 may be operated manually, mechanically by opening at a determined water level or pressure, or electronically by monitoring the water level 21 with electronic sensors. The release valve 19 may be opened and may allow air and/or water to flow therethrough. Consequently, the release valve 19 may allow any water in excess of the maximum water level 21 to flow out of the release valve 19. The release valve 19 may be closed thereafter.

The water tank 1 may be heated by a heating band 18 that may be disposed around the water tank 1. As the water within the water tank 1 is heated, steam may form within the water tank 1. The water tank 1 may be heated at the request of a user through an input switch 15. A thermostat 16 may regulate the temperature of the water tank once the input switch 15 has been engaged. The temperature may be locked so that a user may not increase the temperature above safe levels. A specific temperature may be set by a factory skilled technician when the cleaning and polishing apparatus 30 is manufactured, when the cleaning and polishing apparatus 30 is repaired, of the like. The thermostat 16 may have an electrical connection 17 to the heating band 18 such that the heating band 18 heats to the temperature set by the thermostat 16. The heating band 18 may stay on until the thermostat 16 is lowered or the cleaning and polishing apparatus 30 is turned off. Alternatively, the heating band 18 may turn off automatically after a period of time. The heating band 18 may further fluctuate in temperature so long as the temperature of the water is maintained at the temperature set by the thermostat 16. Alternatively, the cleaning and polishing apparatus 30 may be programed to heat to a pre-determined temperature or to a pre-determined pressure. Of course, other methods of heating the water tank 1 may be utilized without departing from the scope of the present invention.

As the water tank 1 is heated, the water therein may boil and form water vapor or steam. As a result, the pressure in the water tank 1 may rise. The pressure may be predetermined by a qualified technician when manufactured, such as at a few atmospheres or within a range such as 60-80 pounds per square inch. Of course, higher or lower pressures may be used and higher or lower certified water tanks may be used to accommodate said higher or lower pressures. The pressure inside the water tank 1 may be displayed on a gauge 10, disposed on the outside of the cleaning and polishing apparatus 30. If the pressure exceeds a pressure limit on the water tank 1 or a pre-determined pressure limit, a safety valve 11 may release the excess pressure until the desired pressure is maintained. Of course the safety valve 11 may release excess pressure in alternative scenarios, such as mechanical or electrical malfunction, so as to protect the user and the cleaning and polishing device 30.

The cleaning and polishing apparatus 30 may further have a compound tank 2 capable of holding an amount of compound 14. The compound 14 may be a cleaning solution, a polishing solution, or similar enhancing compound known to one skilled in the art. The compound tank 2 may be similarly filled using a funnel 5 and opening a fill valve 4 as discussed in regard to the water tank 1. Further, compound 14 may traverse from the fill valve 4 through a pipe 13 and into the compound tank 2. The compound tank 2 may be emptied by opening fill valve 4 and flipping the cleaning and polishing apparatus 30 upside down and removing the liquid therein. The compound tank 2 may be refilled after prolonged use of the cleaning and polishing apparatus 30.

Water and compound 14 may be mixed together by a mixing valve 8. The mixing valve 8 may be disposed near the outside of the cleaning and polishing apparatus 30 so a user may control the same. The mixing valve 8 may control a flow of water, and how much that water is in the flow, from water tank 1 to compound tank 2. Specifically, water may travel from water tank 1 through a first line 20, pass through mixing valve 8 and enter compound tank 2. As water enters compound tank 2, the water may mix with the compound 14 and may dilute concentration of the compound 14. At the same time, the water and compound 14 mixture may travel through a second line 24 towards a compound solenoid valve 7 so that a vacuum is not formed within the compound tank 2. In this way, the percentage of compound 14 may change from 100% to 0%. Of course, the present invention may be designed such that any combination of water and compound 14 may be mixed. For example, in one embodiment there may be 43% water and 57% compound 14. In an alternate embodiment there may be 57% water and 43% compound 14. In another embodiment there may be 100% water vapor, steam and 0% compound 14.

Once a desired combination of water and compound 14 are mixed, the combination may travel through the second line 24 to the compound solenoid valve 7, or other alternate valve. The compound solenoid valve 7 or other alternate valve may be turned on and may allow allotted portions of water and compound 14 to enter line 9. A steam solenoid valve 6 or other alternate valve may be used to allot portions of steam into line 9. The steam solenoid valve 6 or other alternate valve may be turned on using a foot switch (not shown) and may allow steam to enter line 9 through an opening 23. The compound solenoid valve 7, or other alternate valve and steam solenoid valve 6, or other alternate valve may be used concurrently to propel the water and compound 14 mixture from line 9 through a nozzle 22. The introduction of steam into line 9 from the water tank 1 may force the steam, water, and compound 14 to exit line 9 through the nozzle 22, when an accessory is to be polished and cleaned. As steam enters line 9 through opening 23, the water in water tank 1 may be superheated to create more steam and maintain the pressure in the water tank 1. The compound solenoid valve 7, or other alternate valve and steam solenoid valve 6, or other alternate valve may be turned off and may prevent anything from reaching nozzle 22. The compound solenoid valve 7, or other alternate valve and steam solenoid valve 6, or other alternate valve may alternately be turned on and off automatically at a predetermined pressure, time, or other indicator known to one skilled in the art, or may be turned on and off manually by a user.

At the opening 23, an obstruction 25 may be present within line 9 that increases the pressure, and thereby the flow, of the steam. The increased pressure of the steam within line 9 due to the obstruction 25 may ultimately increase the flow of the steam, water, and/or compound 14 that is expelled from line 9 via the nozzle 22. The obstruction 25 may be disposed anywhere between the steam solenoid valve 6 and the opening 23 in the line 9 that maximizes the efficiency of the cleaning and polishing apparatus. In one embodiment, as shown in FIG. 1, the obstruction 25 may be at a location furthest from the steam solenoid valve 6. In a preferred embodiment, the obstruction 25 may be located 1.5 inches in from the opening 23.

The nozzle 22 may be tapered into a cone such that the combination is expelled at a high velocity. An accessory 37 may be held beneath nozzle 22 with a holding tool or alternatively the accessory 37 may be held in a basket or tray or other accessory holder 35 disposed beneath the nozzle 22. In one embodiment, a user may clean and polish an accessory by placing the accessory beneath the nozzle 22. The user may select a combination of steam and compound 14 using mixing valve 8. The temperature and the pressure may automatically adjust to factory set values upon a user engaging the input switch 15. These factory set values may be determined by a skilled technician during manufacturing, during repair, or the like. Once the cleaning and polishing apparatus 30 has enough pressure, a quantity of steam, water, and compound 14 may enter into line 9. The resulting combination in line 9 may be expelled from the nozzle 22 and may clean and polish the accessory. Alternatively, the cleaning and polishing apparatus 30 may expel only steam, such as when the compound is completely diluted. Steam may flow through line 9 without any compound 14 and may be expelled from nozzle 22. The steam-only flow may rinse and dry the accessory, leaving it shiny, clean, and like new. Of course, a user may use the mixing valve 8 to prevent water from entering the compound tank 2. This may allow a user to encompass the accessory with a less diluted compound 14 if desired.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An accessory cleaning and polishing apparatus, the apparatus comprising:

a housing;

a water tank within the housing capable of holding water and steam therein;

a compound tank within the housing capable of holding a compound and water;

a first line connecting the water tank and the compound tank and configured to pull water from the water tank and into the compound tank;

a mixing valve connected to the first line and disposed between the compound tank and water tank, wherein the mixing valve is configured to regulate the water pulled into the compound tank; and a second line extending from inside the water tank at a first end to outside the housing at a second end and connected to the compound tank via a third line, wherein the second line and the third line are configured to allow steam from the water tank, and water and compound from the compound tank to traverse therethrough and exit the housing.

2. The apparatus of claim 1 further comprising a first solenoid valve connected to the second line that controls a flow of steam through the second line.

3. The apparatus of claim 1 further comprising a first solenoid valve connected to the third line that controls a flow of water and compound through the third line.

4. The apparatus of claim 1 further comprising a thermostat that regulates the temperature of the water tank.

5. The apparatus of claim 1 further comprising a pressure gauge that indicates the pressure of the water tank.

6. The apparatus of claim 1 further comprising controls for regulating the temperature and the pressure.

7. The apparatus of claim 1 further comprising:

a nozzle disposed on the second end of the second line.

8. An accessory cleaning and polishing system, the system comprising:

an accessory cleaning and polishing apparatus comprising a housing, a water tank within the housing capable of holding water and steam therein, a compound tank within the housing capable of holding a compound and water mixture, a first line connecting the water tank and the compound tank and configured to pull water from the water tank into the compound tank, a mixing valve connected to the first line and disposed between the compound tank and water tank, wherein the mixing valve is configured to regulate the water pulled into the compound tank, a second line extending from inside the water tank on a first end to outside the housing on a second end and connected to the compound tank via a third line, wherein the second line and the third line are configured to allow steam from the water tank, and water and compound from the compound tank to traverse therethrough and exit the housing, and a nozzle connected to the second end of the second line, wherein the nozzle is disposed downwardly; and an accessory holder disposed on the outside of the housing and beneath the nozzle, wherein the accessory holder is configured to suspend an accessory for cleaning and polishing the same.

9. The system of claim 8 further comprising an accessory disposed in the accessory holder.

10. The system of claim 8 further comprising controls for manually setting the temperature and the pressure.

11. The system of claim 8 further comprising a first solenoid valve connected to the second line that controls the flow of steam through the second line.

12. The system of claim 8 further comprising a first solenoid valve connected to the third line that controls the flow of water and compound through the line.

13. The system of claim 8 further comprising an obstruction disposed within the second line.

14. The system of claim 13 wherein the obstruction is disposed 1.5 inches in from the first end of the second line.

* * * * *